US011566492B1

(12) United States Patent
Maher et al.

(10) Patent No.: US 11,566,492 B1
(45) Date of Patent: Jan. 31, 2023

(54) DOWNHOLE TOOL WITH CASING SCRAPER WITH INDUCED ROTATION

(71) Applicant: Halliburton Energy Services, Inc., Houston, TX (US)

(72) Inventors: Peter Reid Maher, Lafayette, LA (US); Brittany Morgan Emerson, Addison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/444,903

(22) Filed: Aug. 11, 2021

(51) Int. Cl.
*E21B 37/02* (2006.01)
*E21B 23/00* (2006.01)

(52) U.S. Cl.
CPC ..... *E21B 37/02* (2013.01); *E21B 23/006* (2013.01)

(58) Field of Classification Search
CPC ..... E21B 23/006; E21B 37/02
See application file for complete search history.

(56) References Cited

U.S. PATENT DOCUMENTS 2,679,905 A * 6/1954 Magnum ..... E21B 37/02 166/175
4,648,447 A 3/1987 Bishop et al.
4,798,246 A 1/1989 Best
7,513,302 B2 4/2009 Cassidy et al.
2008/0156479 A1 7/2008 Cassidy et al.
2016/0145973 A1 5/2016 Lykkebo
2016/0312582 A1* 10/2016 Ali ..... E21B 37/02
2020/0080400 A1* 3/2020 Garcia ..... E21B 37/02

FOREIGN PATENT DOCUMENTS

CN 110608000 A 12/2019
CN 210948596 U 7/2020
GB 2445439 A 9/2008

OTHER PUBLICATIONS

International Search Report and Written Opinion dated Apr. 29, 2022 for corresponding PCT Application No. PCT/US2021/045631 filed Aug. 12, 2021.

* cited by examiner

*Primary Examiner* — Robert E Fuller
*Assistant Examiner* — Lamia Quaim
(74) *Attorney, Agent, or Firm* — K&L Gates LLP

(57) ABSTRACT

A downhole tool for cleaning debris from an inner surface of a downhole casing that includes an inner mandrel moveable within the casing; and a scraper mandrel movably coupled to the outside of the inner mandrel by the engagement of a lug within a groove, the scraper mandrel including a scraper blade positioned on an outside of the scraper mandrel. Longitudinal movement of the scraper mandrel relative to the inner mandrel causes the lug to move within the groove, causing the scraper mandrel and the scraper blade to rotate relative to the inner mandrel and clean debris from the inner surface of the casing. The longitudinal movement is achieved by restraining movement of the scraper mandrel relative to the inner mandrel by contacting the debris with a scraper blade on the outside of the scraper mandrel, causing the scraper mandrel to move longitudinally relative to the inner mandrel.

18 Claims, 10 Drawing Sheets

DOWNHOLE TOOL WITH CASING SCRAPER WITH INDUCED ROTATION

BACKGROUND

This section is intended to provide relevant background information to facilitate a better understanding of the various aspects of the described embodiments. Accordingly, these statements are to be read in this light and not as admissions of prior art.

Many wellbore drilling, completion, and/or production operations in the oil and gas industry require isolation of a particular zone within a wellbore to achieve a desired result. However, multiple trips are often required to isolate the particular zone, to perform the wellbore operation, and to carry on another subsequent wellbore operation effectively. For example, a trip may be required to set the isolation tool in a casing extending within the wellbore at a depth interval so that the particular zone requiring isolation for execution of the wellbore operation is isolated. Another trip may be required to complete the wellbore operation. Yet another trip may be required to remove the isolation tool. Still another trip may be required to carry on another wellbore operation subsequently. Moreover, depending on the characteristics of the wellbore and the casing, one or more additional trips may be necessary to clean the casing at the depth interval before the isolation tool is set at the depth interval to ensure an effective seal between the isolation tool and the casing. It would therefore be desirable to reduce the number of trips required to isolate the particular zone, to perform the wellbore operation, and to carry on another subsequent wellbore operation effectively. Therefore, what is needed is an apparatus, system, and/or method that addresses one or more of the foregoing issues, and/or one or more other issues.

BRIEF DESCRIPTION OF THE DRAWINGS

Embodiments of the casing scraper with induced rotation are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes a downhole tool with a casing scraper usable as part of a system for cleaning debris from an inner surface of a downhole casing. The downhole tool uses an inner mandrel moveable within the casing. A scraper mandrel is moveable on the outside of the inner mandrel by the engagement of a lug moveable within a groove. The scraper mandrel includes a scraper blade positioned on the outside of the scraper mandrel that engages the inner surface of the casing. As the inner mandrel moves within the casing, friction from engagement of the scraper blade with the casing restrains movement of the scraper mandrel relative to the inner mandrel, causing the lug to move within the groove and rotate the scraper blade to clear debris from the inner surface of the casing.

Although a figure may depict a horizontal wellbore or a vertical wellbore, unless indicated otherwise, the various aspects of the present disclosure are equally well suited for use in wellbores having other orientations including vertical wellbores, horizontal wellbores, slanted wellbores, multilateral wellbores, or the like. Unless otherwise noted, even though a figure may depict an offshore operation, the various aspects of the present disclosure are equally well suited for use in onshore operations. Unless otherwise noted, even though a figure may depict a cased-hole wellbore, the various aspects of the present disclosure are equally well suited for use in open-hole wellbore operations.

Figure 1:
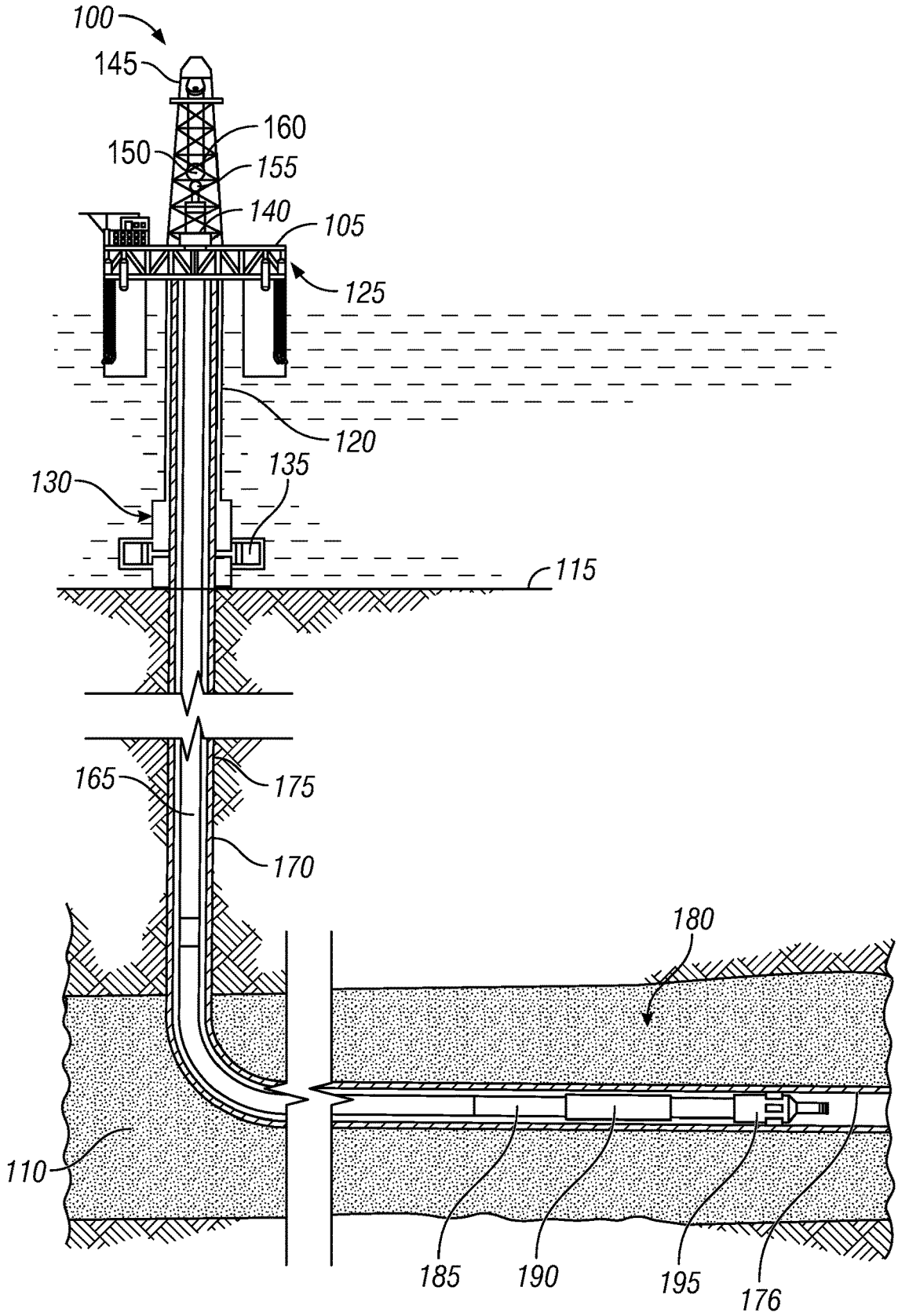
FIG. 1 is an elevation view of an offshore oil and gas platform operably coupled to a downhole tool extending within a wellbore, according to one or more embodiments of the present disclosure.

Referring to FIG. 1, an offshore oil and gas platform 100 is schematically illustrated. The offshore oil and gas platform 100 includes a semi-submersible platform 105 that is positioned over a submerged oil and gas formation 110 located below a sea floor 115. A subsea conduit 120 extends from a deck 125 of the platform 105 to a subsea wellhead installation 130. One or more pressure control devices 135, such as, for example, blowout preventers (BOPs), and/or other equipment associated with drilling or producing a wellbore may be provided at the subsea wellhead installation 130 or elsewhere in the system. The platform 105 may include a hoisting apparatus 140, a derrick 145, a travel block 150, a hook 155, and a swivel 160, which components are together operable for raising and lowering a conveyance string 165.

The conveyance string 165 may be, include, or be part of, for example, a casing, a drill string, a completion string, a work string, a pipe joint, coiled tubing, production tubing, other types of pipe or tubing strings, and/or other types of conveyance vehicles, such as wireline, slickline, and/or the like. For example, the conveyance string 165 may be an axially extending tubular string made up of a plurality of pipe joints coupled to together end-to-end. The platform 105 may also include a kelly, a rotary table, a top drive unit, and/or other equipment associated with the rotation and/or translation of the conveyance string 165. A wellbore 170 extends from the subsea wellhead installation 130 and through the various earth strata, including the formation 110. At least a portion of the wellbore 170 includes a downhole casing 175 cemented therein. The casing 175 includes an inner surface 176 to which debris may adhere over time.

A generally tubular downhole tool 180 is connected to the conveyance string 165 and extends within the wellbore 170. The downhole tool 180 includes a setting tool 185, an isolation tool 190 connected to the setting tool 185, and a casing scraper 195. Although described herein as part of the downhole tool 180, the casing scraper 195 may instead be deployed into the wellbore 170 as a standalone device for cleanout runs or integrated into a single-trip system in combination with other wellbore cleaning tools. The conveyance string 165 is adapted to convey the downhole tool 180 into the wellbore 170. In addition, or instead, the downhole tool 180 may be a "pumpdown" type tool conveyable into the wellbore 170 by hydraulic pressure inside the casing 175 and above the downhole tool 180. The setting tool 185 may be, for example, an electric wireline, slickline, coiled tubing, mechanical, or hydraulic setting tool.

The isolation tool 190 is adapted to provide zonal isolation of the wellbore 170 so that a wellbore operation in which such isolation is required may be performed. In some embodiments, the isolation tool 190 is a frac plug used primarily between zones in multistage stimulation treatments, in which case the frac plug is adapted to isolate a lower zone during stimulation but to allow flow from below once the stimulation is over to aid in well cleanup. The isolation tool 190 may be, for example, a bridge plug that can be used in multistage stimulation treatments to provide isolation between zones or to provide a barrier for temporary abandonment or BOP change out. The isolation tool 190 may alternatively be a packer such as, for example, a squeeze packer. The isolation tool 190 may also be any one of Halliburton's EZ DRILL®, FAS DRILL®, and/or OBSIDIAN® plugs and packers.

Referring to FIGS. 2A-2F, an embodiment of a downhole tool 200 in the form of a casing scraper is shown. The downhole tool 200 may be used, for example as the casing scraper 195 shown in FIG. 1. The downhole tool 200 is moveable within the downhole casing 175 and includes an inner mandrel 202 and a scraper mandrel 204 that is coupled to and moveable on the outside of the inner mandrel 202. The coupling is accomplished by the engagement of one or more lugs 206 on the inside of the scraper mandrel 204 moveable within a groove 208 in the inner mandrel 202. Although the lugs 206 are shown on the scraper mandrel 204 and the groove 208 is shown in the inner mandrel 202, it should be appreciated that the lugs 206 may instead be on the inner mandrel 202 and the groove 208 be on the scraper mandrel 204. Relative linear movement between the inner mandrel 202 and the scraper mandrel 204 causes the lugs 206 to move longitudinally within the groove 208. In addition, the groove 208 is shaped such that movement of the lugs 206 within the groove 208 also causes the scraper mandrel 204 to rotate relative to the inner mandrel 202. Alternatively, although shown with just a single scraper mandrel 204, the downhole tool 200 may include multiple scraper mandrels 204. Further, the inner mandrel 202 may include longitudinally separated sets of grooves 208, one set for each scraper mandrel 204. Some of the sets of grooves 208 may also be oriented in opposite helical configurations such that longitudinal movement of the scraper mandrels 204 in the same direction relative to the inner mandrel causes the scraper mandrels to rotate in opposite directions. Although not shown, the downhole tool 200 may also include stabilizers or centralizers to support the movement of the downhole tool 200 within the casing.

Movement of the scraper mandrel 204 longitudinally relative to the inner mandrel 202 from an initial position acts on a biasing device 210 located in a space between the inner mandrel 202 and the scraper mandrel 204. As shown, the biasing device is a compression spring and the relative movement compresses the spring. However, other biasing devices, such as a hydraulic- or an electrical-based biasing device may also be used. Relative linear movement between the scraper mandrel 204 and the inner mandrel 202 produces a force from the biasing device 210 acting to return the scraper mandrel 204 to the initial position. For example, compressing a spring produces a force from the spring acting back on the scraper mandrel 204 in the downhole direction to return the scraper mandrel 204 to the initial position. The space between the scraper mandrel 204 and the inner mandrel 202 for the biasing device 210 may also be fluid filled. If desired, the inner mandrel may further include ports 212 to allow fluid or debris to flow into and out of the space for the biasing device 210 as the scraper mandrel 204 moves longitudinally back and forth relative to the inner mandrel 202. Allowing fluid to flow in and out of the space also prevents the downhole tool 200 from becoming hydraulically locked.

The scraper mandrel 204 further includes at least one scraper blade 214 positioned on the outside of the scraper mandrel 204. As shown, there are six scraper blades 214 positioned around the scraper mandrel 204. However, there can be more or fewer than six depending on the design preferences for the downhole tool 200. Each scraper blade 214 fits within a pocket in the outside of the scraper mandrel 204. With the scraper blades 214 positioned within the pockets, the scraper blades are held in place using a retainer 216 that connects with the outside of the scraper mandrel 204. Even with the retainer 216 in place, each scraper blade 214 is allowed to move radially relative to the scraper mandrel 204, although such movement is restrained by a flange/lip interaction between the scraper blade 214 and the scraper mandrel 204 and potentially also the retainer 216. Each scraper blade 214 is also biased radially outward by a spring 218 between each scraper blade 214 and the outside of the scraper mandrel 204. Each spring biases a scraper blade 214 outward but allows the scraper blade 214 to retract radially inward upon sufficient force against the spring 218, thus assisting to maintain contact with the inner surface of the casing, even when there is debris located in the casing or if there is a change in size of the inner surface of the casing.

Figure 2A:
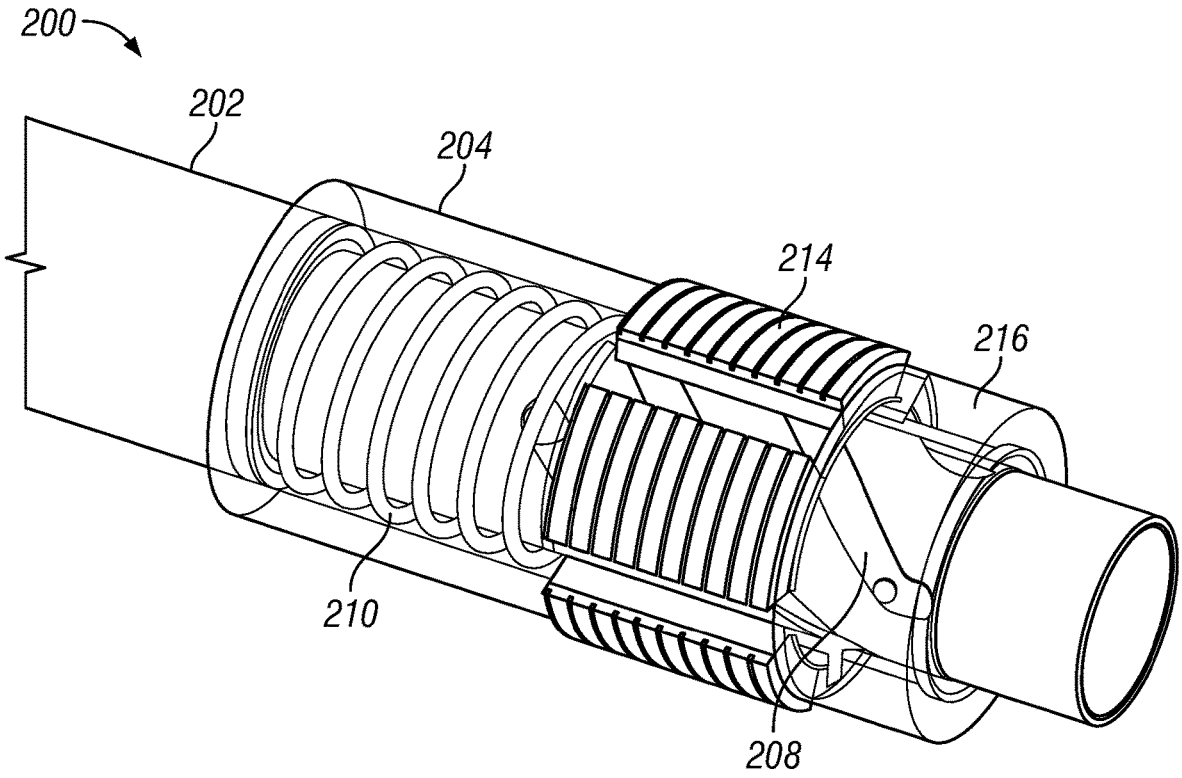
FIGS. 2A-2F are views of an embodiment of a downhole tool with a casing scraper.
Figure 2B:
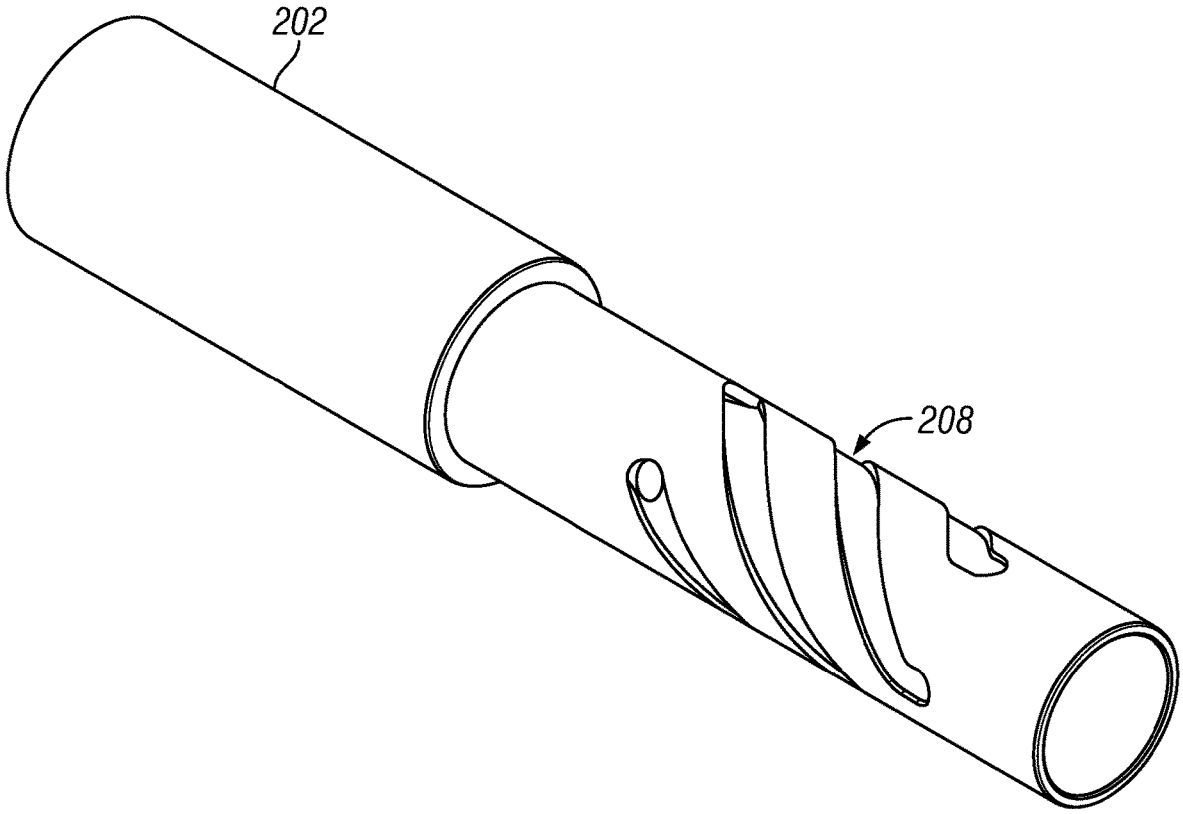
Figure 2C:
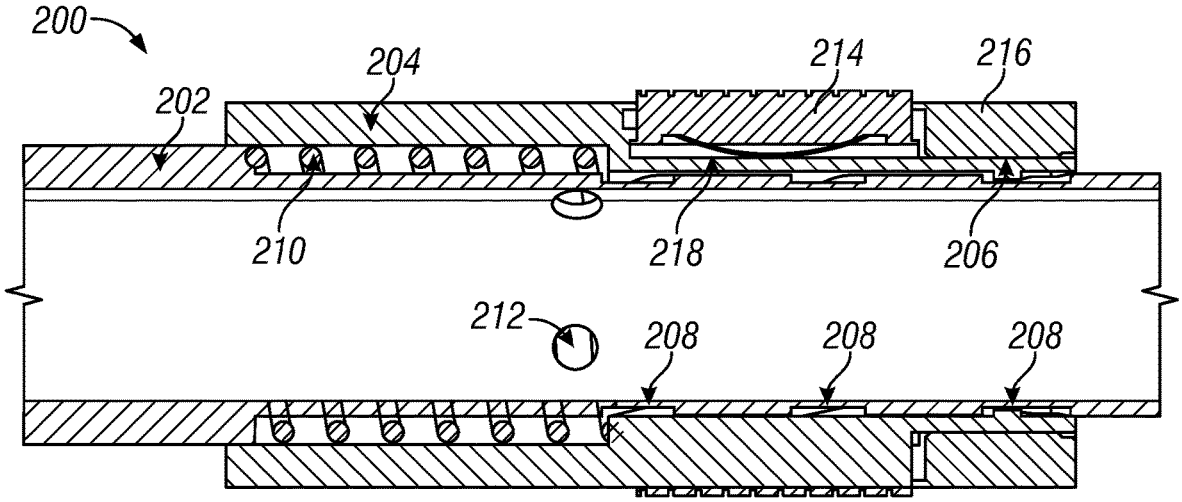
Figure 2D:
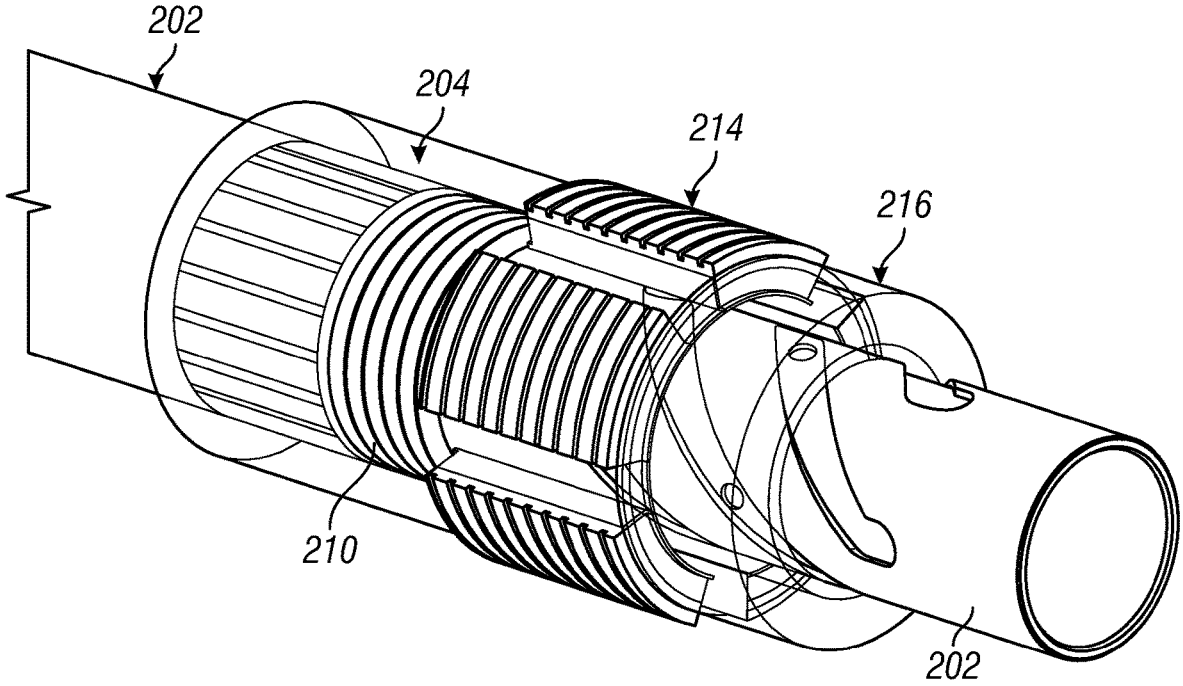
Figure 2E:
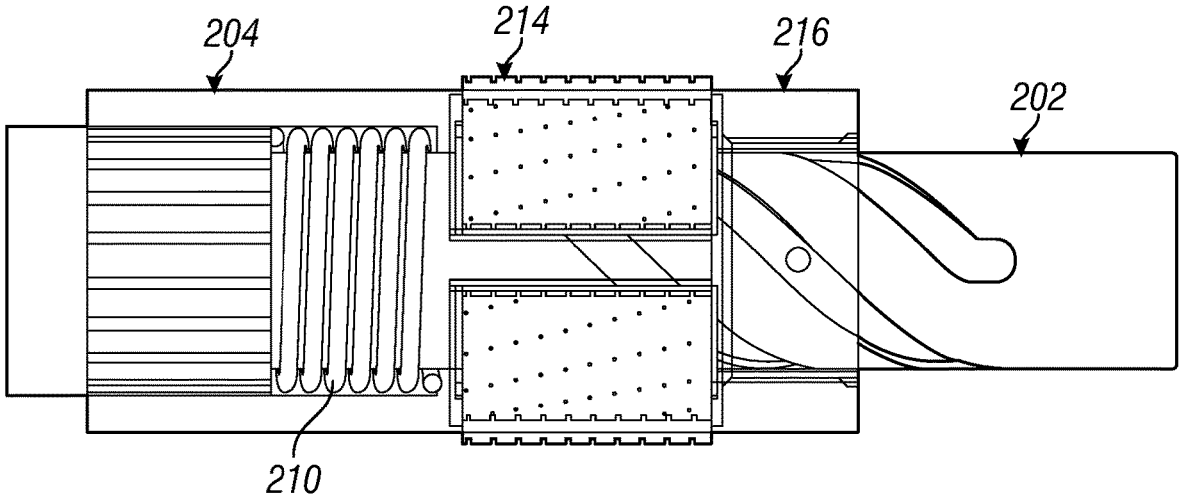

As shown more clearly in FIGS. 2D and 2E, in use, the downhole tool 200 is moved within the casing. As the inner mandrel 202 moves within the casing, friction from engagement of the scraper blades 214 with the casing or debris on the inner surface of the casing restrains movement of the scraper mandrel 204 relative to the inner mandrel 202, causing the lugs 206 to move within the grooves 208. With the grooves 208 being configured in a spiral or helical orientation, linear movement of the scraper mandrel 204 relative to the inner mandrel 202 causes the scraper mandrel 204 and thus the scraper blades 214 to rotate within the casing. Rotation of the scraper mandrel 204 and the scraper blades 214 in this manner acts to clean and remove debris from the entire circumference of the inner surface of the casing.

In addition to causing rotation of the scraper mandrel 204, longitudinal movement of the scraper mandrel 204 from an initial position acts on the biasing device 210 to produce a force to return the scraper mandrel 204 to the initial position. For example, compressing a spring produces a force from the spring acting back on the scraper mandrel 204 to return the scraper mandrel 204 to the initial position. Thus, as the scraper blades 214 clean the inner surface of the casing to remove debris, the force acting on the scraper mandrel 204 by the contact with the debris decreases or ends, allowing the force from the biasing device 210 to return the scraper mandrel 204 to the initial position. When returned to the initial position, the scraper mandrel 204 is ready to encounter additional debris on the inner surface of the casing as the downhole tool 200 continues to move within the casing.

Figure 2F:
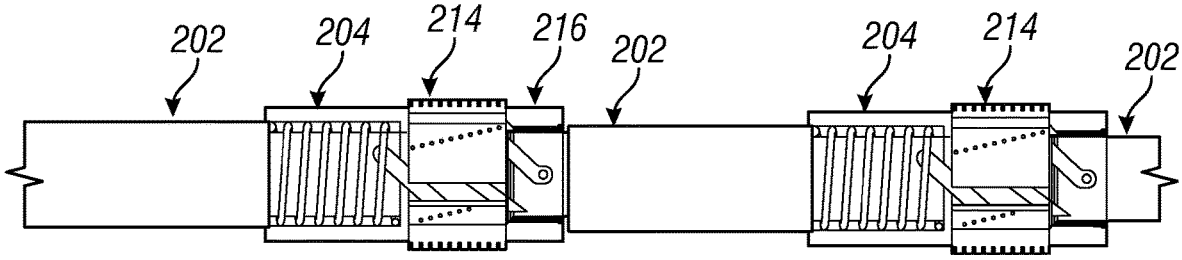

As shown in FIG. 2F, the downhole tool 200 may include multiple scraper mandrels 204 mounted either on a single inner mandrel 202 or a string of inner mandrels 202. For each scraper mandrel 204, there is a corresponding set of grooves 208 separated longitudinally along the inner mandrel 202. As shown, the sets of grooves 208 are oriented in opposite configurations such that the longitudinal movement of the scraper mandrels 204 in the same direction causes at least two scraper mandrels 204 to rotate in opposite directions.

Figure 3A:
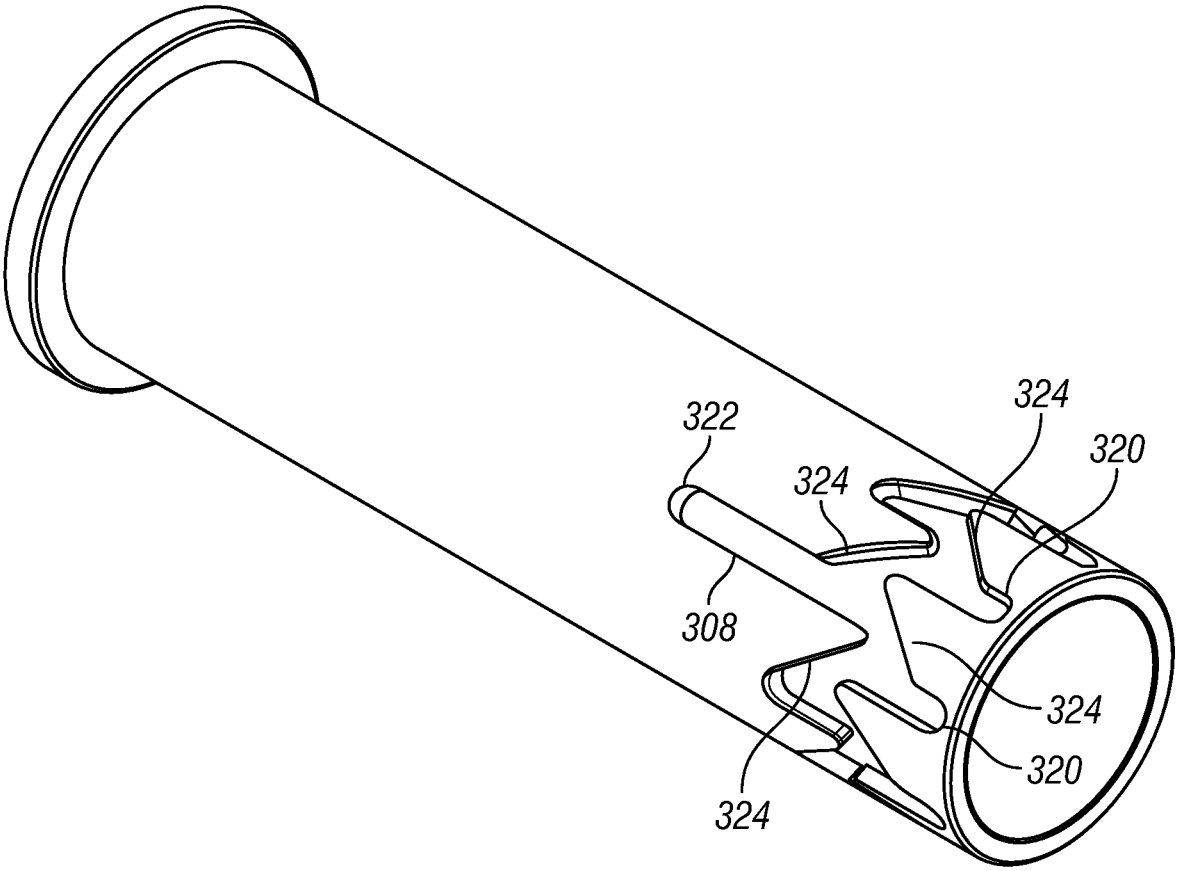
FIGS. 3A-C are views of an alternative embodiment of a downhole tool with a casing scraper.
Figure 3B:
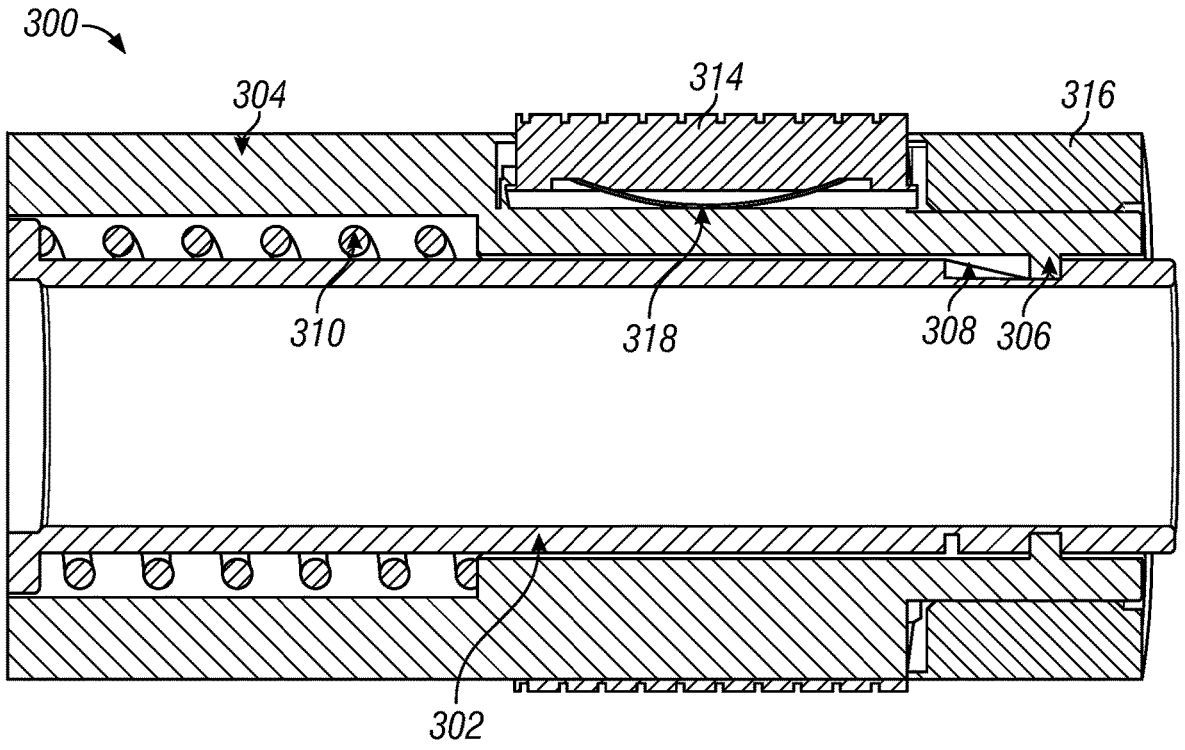
Figure 3C:
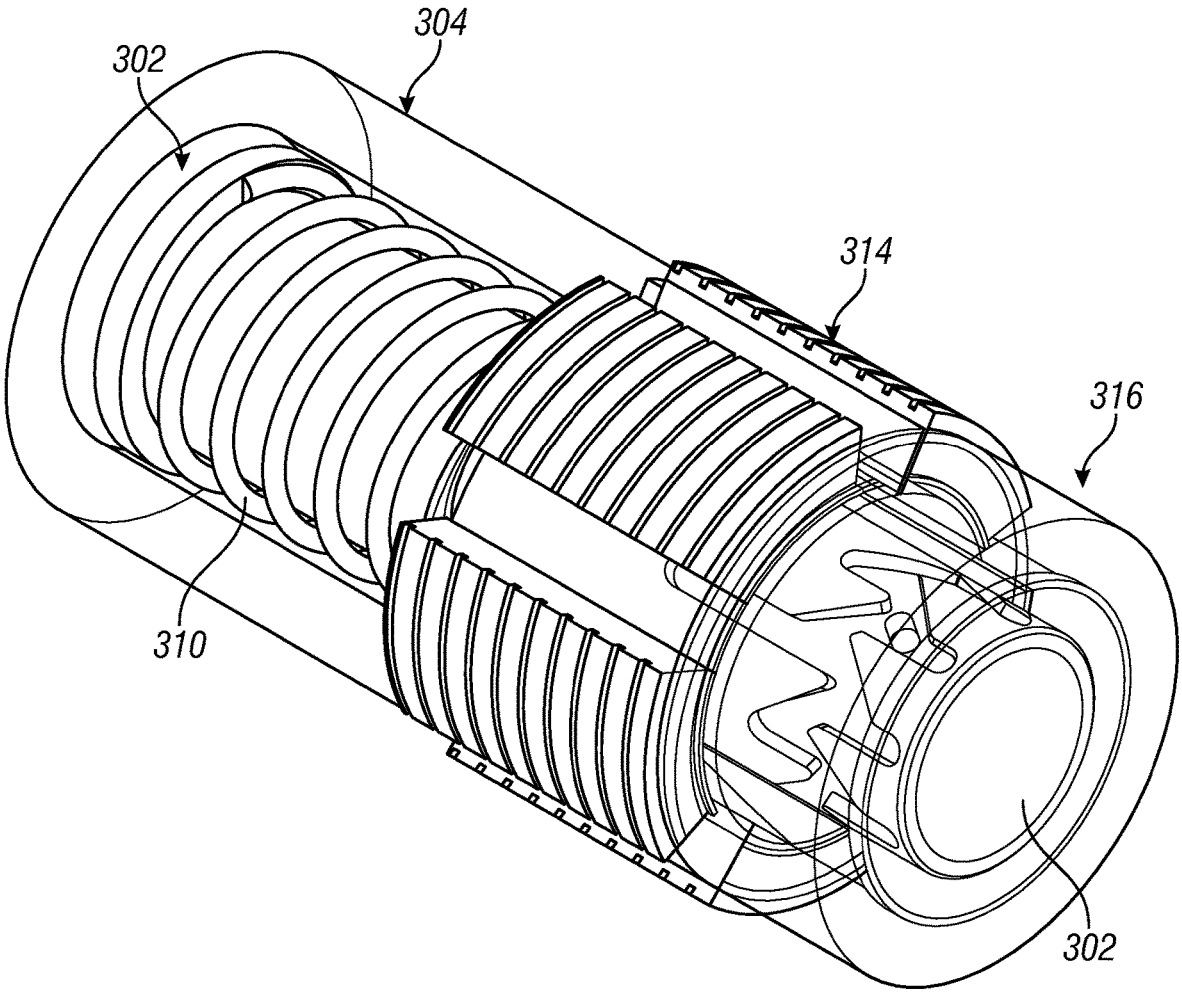

Referring to FIGS. 3A-3C, another embodiment of a downhole tool 300 in the form of a casing scraper is shown. Components similar to the downhole tool 200 are given similar reference numbers and include an inner mandrel 302 and a scraper mandrel 304. A lug 306 travels within a groove 308. Scraper blades 314 are biased radially outward by springs 318 and held in place using a retainer 316. Longitudinal movement of the scraper mandrel 304 relative to the inner mandrel 302 when encountering friction or debris activates a biasing device 310, which may be a spring as shown, to produce a force to return the scraper mandrel 304 to an initial position. As components are similar to the downhole tool 200, the discussion of the arrangement of the components and alternatives applies to the downhole tool 300 as well. However, unlike the downhole tool 200, in the downhole tool 300 the groove 308 is configured as a continuous "J-slot" groove that extends around the circumference of the inner mandrel 302. As best shown in FIG. 3A, the groove 308 includes a continuous path with downhole stop positions 320 and uphole stop positions 322 spaced around the circumference of the inner mandrel 302. Each of the downhole stop positions 320 and uphole stop positions 322 include at least a portion of the groove 308 oriented longitudinally. These longitudinal portions allow the scraper mandrel 304 to move longitudinally within the portions without rotating. The downhole stop positions 320 and the uphole stop positions 322 are arcuately offset from each other, with sloped surfaces 324 on the wall of the groove 308 opposite each. As the scraper mandrel 304 reciprocates back and forth in the uphole and downhole directions, the lug 306 moves within the channel 308 and contacts the sloped surfaces 324. Continued movement of the lug 306 longitudinally along a particular sloped surface 324 then also causes the scraper mandrel 304 to rotate, which also aligns the lug 308 with the next downhole stop position 320 or uphole stop position 322. Reciprocal movement of the scraper mandrel 304 relative to the inner mandrel 302 thus rotates the scraper mandrel 304 and the scraper blades 314 to clean and remove debris from the entire circumference of the inner surface of the casing. Although not shown, the downhole tool 300 may also include stabilizers or centralizers to support the movement of the downhole tool 300 within the casing.

In addition to causing rotation of the scraper mandrel 304, longitudinal movement of the scraper mandrel 304 from an initial position acts on the biasing device 310 to produce a force to return the scraper mandrel 304 to the initial position. For example, compressing a spring produces a force from the spring acting back on the scraper mandrel 304 to move the scraper mandrel 304 in the downhole direction. Thus, as the scraper blades 314 clean the inner surface of the casing to remove debris, the force acting on the scraper mandrel 304 by the contact with the debris decreases or ends, allowing the force from the biasing device 310 to move the scraper mandrel 304 downhole relative to the inner mandrel 302. Doing so moves the lug 306 to the next downhole stop position 320 in the groove 308, where the scraper mandrel 304 is ready to encounter additional debris on the inner surface of the casing as the downhole tool 300 continues to move within the casing.

As with the downhole tool 200, the downhole tool 300 may include multiple scraper mandrels 304 mounted on either a single inner mandrel 302 or a string of inner mandrels 302. For each scraper mandrel 304, there is a corresponding groove 308 separated longitudinally along the inner mandrel 302. The grooves 308 are oriented in opposite configurations such that the longitudinal movement of the scraper mandrels 304 in the same direction causes at least two scraper mandrels 304 to rotate in opposite directions.

Examples of the above embodiments include the following numbered examples:

Example 1 is a downhole tool for cleaning debris from an inner surface of a downhole casing, comprising an inner mandrel moveable within the casing and a scraper mandrel movably coupled to the outside of the inner mandrel by the engagement of a lug within a groove, the scraper mandrel comprising a scraper blade positioned on an outside of the scraper mandrel. Longitudinal movement of the scraper mandrel relative to the inner mandrel causes the lug to move within the groove, causing the scraper mandrel and the scraper blade to rotate relative to the inner mandrel and clean debris from the inner surface of the casing.

Example 2. The downhole tool of Example 1, further comprising more than one groove, each groove comprising a helical configuration.

Example 3. The downhole tool of Example 1, wherein the groove comprises a continuous J-slot.

Example 4. The downhole tool of Example 1, further comprising a biasing device activated to produce a force acting on the scraper mandrel by the longitudinal movement of the scraper mandrel relative to the inner mandrel.

Example 5. The downhole tool of Example 1, further comprising multiple scraper blades sized and positioned to contact the debris and restrain and cause the longitudinal movement of the scraper mandrel relative to the inner mandrel.

Example 6. The downhole tool of Example 5, wherein each scraper blade is biased radially outward by a spring.

Example 7. The downhole tool of Example 1, further comprising multiple scraper mandrels and multiple grooves separated longitudinally.

Example 8. The downhole tool of Example 7, wherein the grooves are oriented in opposite configurations such that longitudinal movement of the scraper mandrels in the same direction causes at least two scraper mandrels to rotate in opposite directions.

Example 9. The downhole tool of Example 1, further comprising ports for fluid and debris flow from longitudinal movement of the scraper mandrel relative to the inner mandrel.

Example 10. A method of cleaning debris from an inner surface of a downhole casing, comprising moving a downhole tool through the casing, the downhole tool comprising a scraper mandrel movably coupled to the outside of an inner mandrel; restraining movement of the scraper mandrel relative to the inner mandrel by contacting the debris with a scraper blade on the outside of the scraper mandrel, causing the scraper mandrel to move longitudinally relative to the inner mandrel; and moving a lug within a groove from the relative longitudinal movement of the scraper mandrel relative to the inner mandrel to cause the scraper mandrel and the scraper blade to rotate relative to the casing and clean debris from the inner surface of the casing.

Example 11. The method of Example 10, wherein the downhole tool comprises more than one groove, each groove comprising a helical configuration.

Example 12. The method of Example 10, wherein the groove comprises a continuous J-slot.

Example 13. The method of Example 10, further comprising activating a biasing device with the relative longitudinal movement to produce a force acting on the scraper mandrel.

Example 14. The method of Example 10, further comprising restraining movement of the scraper mandrel relative to the inner mandrel by contacting the debris with multiple scraper blades on the outside of the scraper mandrel Example 15. The method of Example 10, further comprising multiple scraper mandrels and multiple grooves separated longitudinally.

Example 16. The method of Example 15, wherein the grooves are oriented in opposite configurations such that longitudinal movement of the scraper mandrels in the same direction causes at least two scraper mandrels to rotate in opposite directions.

Example 17. The method of Example 10, further comprising communicating pressure through ports due to the relative longitudinal movement.

Example 18. A system for cleaning debris from an inner surface of a downhole casing, the system comprising a conveyance string and a downhole tool connected to the conveyance string and comprising: an inner mandrel moveable within the casing; and a scraper mandrel movably coupled to the outside of the inner mandrel by the engagement of a lug within a groove, the scraper mandrel comprising a scraper blade positioned on an outside of the scraper mandrel; wherein longitudinal movement of the scraper mandrel relative to the inner mandrel causes the lug to move within the groove, causing the scraper mandrel and the scraper blade to rotate relative to the inner mandrel and clean debris from the inner surface of the casing Example 19. The system of Example 18, further comprising more than one groove, each groove comprising a helical configuration.

Example 20. The system of Example 18, wherein the groove comprises a continuous J-slot.

Certain terms are used throughout the description and claims to refer to particular features or components. As one skilled in the art will appreciate, different persons may refer to the same feature or component by different names. This document does not intend to distinguish between components or features that differ in name but not function.

While compositions and methods are described herein in terms of "comprising" various components or steps, the compositions and methods can also "consist essentially of" or "consist of" the various components and steps.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A downhole tool for cleaning debris from an inner surface of a downhole casing, comprising:

an inner mandrel moveable within the casing;

a scraper mandrel movably coupled to the outside of the inner mandrel by the engagement of a lug within a groove, the scraper mandrel comprising a scraper blade positioned on an outside of the scraper mandrel; and a biasing device activatable to produce a force acting on the scraper mandrel in a downhole direction by the longitudinal movement of the scraper mandrel relative to the inner mandrel;

wherein longitudinal movement of the scraper mandrel relative to the inner mandrel causes the lug to move within the groove, causing the scraper mandrel and the scraper blade to rotate relative to the inner mandrel and clean debris from the inner surface of the casing.

2. The downhole tool of claim 1, further comprising more than one groove, each groove comprising a helical configuration.

3. The downhole tool of claim 1, wherein the groove comprises a continuous J-slot.

4. The downhole tool of claim 1, further comprising multiple scraper blades sized and positioned to contact the debris and restrain and cause the longitudinal movement of the scraper mandrel relative to the inner mandrel.

5. The downhole tool of claim 4, wherein each scraper blade is biased radially outward by a spring.

6. The downhole tool of claim 1, further comprising multiple scraper mandrels and multiple grooves separated longitudinally.

7. The downhole tool of claim 6, wherein the grooves are oriented in opposite configurations such that longitudinal movement of the scraper mandrels in the same direction causes at least two scraper mandrels to rotate in opposite directions.

8. The downhole tool of claim 1, further comprising ports for fluid and debris flow from longitudinal movement of the scraper mandrel relative to the inner mandrel.

9. A method of cleaning debris from an inner surface of a downhole casing, comprising:

moving a downhole tool through the casing, the downhole tool comprising a scraper mandrel movably coupled to the outside of an inner mandrel;

biasing the scraper mandrel against longitudinal movement relative to the inner mandrel using a biasing device to product a force acting on the scraper mandrel in a downhole direction;

restraining movement of the scraper mandrel relative to the inner mandrel by contacting the debris with a scraper blade on the outside of the scraper mandrel, causing the scraper mandrel to move longitudinally relative to the inner mandrel and against the force of the biasing device; and moving a lug within a groove from the relative longitudinal movement of the scraper mandrel relative to the inner mandrel to cause the scraper mandrel and the scraper blade to rotate relative to the casing and clean debris from the inner surface of the casing.

10. The method of claim 9, wherein the downhole tool comprises more than one groove, each groove comprising a helical configuration.

11. The method of claim 9, wherein the groove comprises a continuous J-slot.

12. The method of claim 9, further comprising restraining movement of the scraper mandrel relative to the inner mandrel by contacting the debris with multiple scraper blades on the outside of the scraper mandrel.

13. The method of claim 9, further comprising multiple scraper mandrels and multiple grooves separated longitudinally.

14. The method of claim 13, wherein the grooves are oriented in opposite configurations such that longitudinal movement of the scraper mandrels in the same direction causes at least two scraper mandrels to rotate in opposite directions.

15. The method of claim 9, further comprising communicating pressure through ports due to the relative longitudinal movement.

16. A system for cleaning debris from an inner surface of a downhole casing, the system comprising:

a conveyance string; and a downhole tool connected to the conveyance string and comprising:

an inner mandrel moveable within the casing;

a scraper mandrel movably coupled to the outside of the inner mandrel by the engagement of a lug within a groove, the scraper mandrel comprising a scraper blade positioned on an outside of the scraper mandrel; and a biasing device activatable to produce a force acting on the scraper mandrel in a downhole direction by the longitudinal movement of the scraper mandrel relative to the inner mandrel;

wherein longitudinal movement of the scraper mandrel relative to the inner mandrel causes the lug to move within the groove, causing the scraper mandrel and the scraper blade to rotate relative to the inner mandrel and clean debris from the inner surface of the casing.

17. The system of claim 16, further comprising more than one groove, each groove comprising a helical configuration.

18. The system of claim 16, wherein the groove comprises a continuous J-slot.

* * * * *